US009309083B1

(12) United States Patent
Peterek

(10) Patent No.: US 9,309,083 B1
(45) Date of Patent: Apr. 12, 2016

(54) DOCUMENT DIVERTER

(71) Applicant: NCR Corporation, Duluth, GA (US)

(72) Inventor: Thomas Gerhard Stephen Peterek, Kitchener (CA)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 14/633,313

(22) Filed: Feb. 27, 2015

(51) Int. Cl.

| | |
|---|---|
| ***B65H 39/10*** | (2006.01) |
| ***B65H 29/58*** | (2006.01) |
| ***B65H 7/02*** | (2006.01) |
| ***B65H 5/06*** | (2006.01) |
| ***B65H 3/06*** | (2006.01) |
| ***B65H 5/02*** | (2006.01) |
| ***B65H 5/36*** | (2006.01) |
| ***B65H 7/20*** | (2006.01) |

(52) U.S. Cl.
CPC ..... *B65H 29/58* (2013.01); *B65H 3/06* (2013.01); *B65H 3/0669* (2013.01); *B65H 5/025* (2013.01); *B65H 5/068* (2013.01); *B65H 5/36* (2013.01); *B65H 7/02* (2013.01); *B65H 7/20* (2013.01)

(58) Field of Classification Search
CPC ..... B65H 5/00; B65H 5/025; B65H 5/06; B65H 5/068; B65H 5/36; B65H 5/38; B65H 7/02; B65H 7/14; B65H 7/20; B65H 3/06; B65H 3/0669; B65H 29/58; B65H 29/60
USPC ..... 271/3.14, 7, 9.01, 9.13, 279, 298, 303
See application file for complete search history.

(56) References Cited

U.S. PATENT DOCUMENTS

| | | | | |
|---|---|---|---|---|
| 5,926,681 | A * | 7/1999 | Ishimaru | G03G 15/60 271/186 |
| 2005/0067748 | A1* | 3/2005 | Fujii | B65H 29/51 270/58.08 |
| 2009/0211874 | A1* | 8/2009 | Oie | B65H 3/44 194/206 |
| 2013/0248334 | A1* | 9/2013 | Togiya | B65H 5/062 198/836.2 |

* cited by examiner

*Primary Examiner* — Prasad Gokhale
(74) *Attorney, Agent, or Firm* — Schwegman, Lundberg & Woessner

(57) ABSTRACT

Embodiments of a document diverter and systems including a document diverter are generally described herein. A document diverter may include a drum, a plurality of document feeders situated around the drum with a document channel between the document feeders and the drum, and a plurality of guiding mechanisms, one guiding mechanism for each of the plurality of document feeders, each of the plurality of guiding mechanisms including a plurality of positions including an first position and a second position.

18 Claims, 7 Drawing Sheets

DOCUMENT DIVERTER

BACKGROUND

A document diverter receives a document (e.g., money, a check, a message, a piece of paper or other fabric) at an input and transports the document to one of a variety of outputs. A six way document diverter has been proposed in U.S. Pat. No. 8,875,991. The six way document diverter has two possible inputs and three possible outputs for each input. The six way document diverter is limited in the number of paths for a document received at the diverter.

SUMMARY

Methods and systems for a document diverter that can include up to sixteen pathways are presented herein.

According to an embodiment, a document diverter is provided that can include a drum, a plurality of document feeders situated around the drum with a document channel between the document feeders and the drum, and a plurality of guiding mechanisms, one guiding mechanism for each of the plurality of document feeders, each of the plurality of guiding mechanisms including a plurality of positions including an first position and a second position.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

A Self-Service Terminal (SST) may be used by a variety of users who may require differing features. For example, one user may wish to retrieve money from a bank account using an SST, while another user may wish to deposit money into their bank account using the SST. The process of retrieving money using the ATM and depositing money using the ATM both generally include the use of a document diverter of the SST.

An SST with cash recycler functionality will likely require a more advanced method of directing documents than is currently available. Currently there are six way diverters available. One or more of the devices discussed herein can divert a document along up to sixteen different pathways. The current diverter is capable of 6 directions, where this unit will be able to handle 12 or even 16 directions of document flow.

Devices discussed herein can direct a document to the appropriate location, utilizing belts and a rubberized drum. Current document diverters, driven by rollers, tend to have a difficult time transporting limp (e.g., thin or worn) documents. The limp documents can cause jamming.

Figure 1:
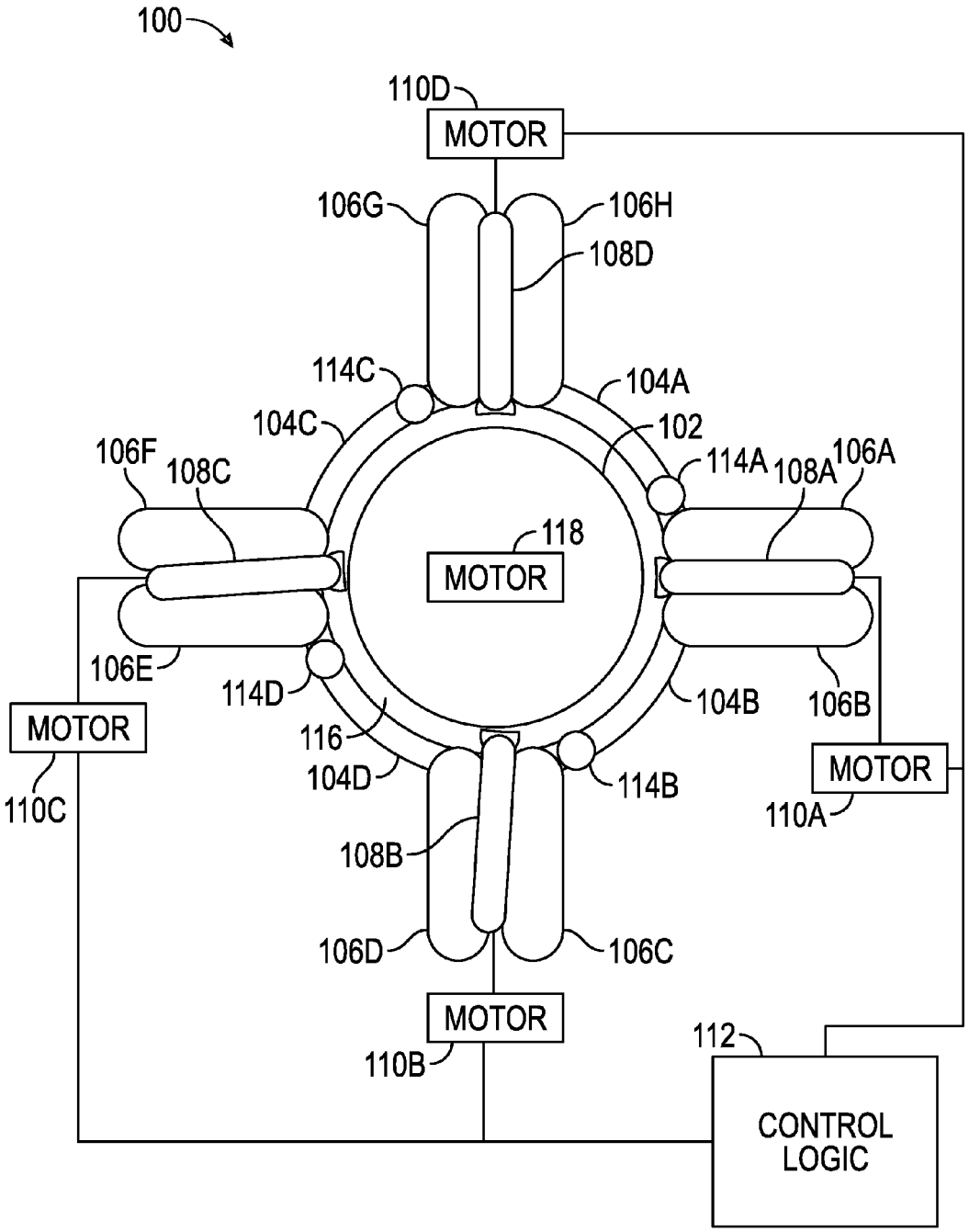
FIG. 1 is a diagram of a document diverter, according to an example embodiment.

FIG. 1 illustrates, by way of example, an embodiment of a document diverter system 100. The system 100 as illustrated includes a document diverter that includes a drum 102, a plurality of drum guides 104A, 104B, 104C, and 104D, a plurality of document feeders, a plurality of guiding mechanisms 108A, 108B, 108C, and 108D. The system 100 as illustrated includes optional motors 110A, 110B, 110C, and 110D mechanically coupled to a respective guiding mechanism 108A-D. Control logic 112 is electrically coupled to the motors 110A-D to control the operation of the motors. Sensors 114A, 114B, 114C, and 114D are situated about the document diverter to produce a signal indicative of a document entering or clearing a document feeder. In one or more embodiments a document diverter can operate the guiding mechanisms 108A-D using a mechanism similar to the mechanism 600 shown in FIG. 6.

The drum 102 can be circular. The drum motor 102 can be rubberized, such as by including a dentated rubber member around the drum 102 (see FIG. 2 for example). Drum 102 can be rotated by a drum motor 118 mechanically coupled thereto. The motor 118 can be electrically coupled to the control logic 112, such that the control logic 112 can control the operation of the drum motor 118. The drum motor 118 can be situated at least partially in an opening in the drum 102, such as to be partially or entirely housed within the opening in the drum 102.

The drum guides 104A-D can be situated around and in proximity to the drum 102, such as to form a document channel 116 between the drum 102 and the drum guides 104A-D. The drum guides 104A-D can provide a structure that allows the document to glide around the drum 102. As the document glides around the drum 102 it can be captured by feeding mechanisms 106A-H with a corresponding guiding mechanism 108A-D that is properly oriented. The drum guides 104A-D can be situated between adjacent document feeders (i.e. a document feeder including a feeding mechanism 106A and 106B is adjacent two document feeders, a first document feeder including feeding mechanisms 106C and 106D and a second document feeder including feeding mechanisms 106G and 106H).

The document feeders as illustrated each include two feeding mechanisms 106A and 106B, 106C and 106D, 106E and 106F, and 106G and 106H, respectively. The feeding mechanisms 106A-H of the respective document feeder are proximate each other, such as to contact opposite sides of a document to be input or output therethrough. The motor 110A can cause the belts of the document feeders to spin in opposite directions. For example, the motor can cause the feeding mechanism 106A to spin clockwise and the feeding mechanism 106B to spin counter-clockwise, simultaneously, so as to make the belts move a document therebetween in the same direction.

Figure 3:
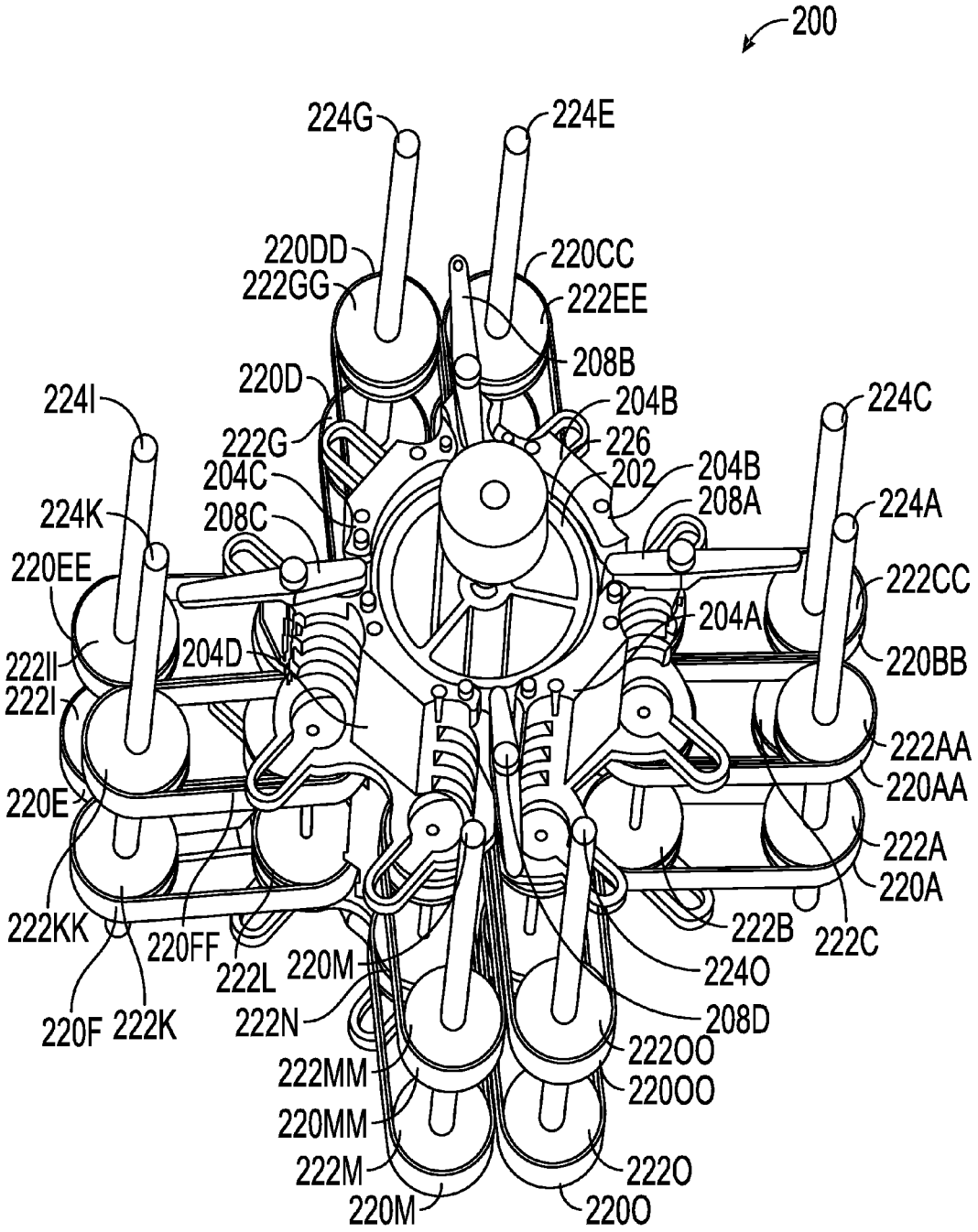
FIG. 3 is a perspective view diagram of the document diverter of FIG. 2, according to an example embodiment.

The feeding mechanisms 106A-H can each include two rollers with a belt around the two rollers, such that the belt makes contact with a document. In one or more embodiments, the feeding mechanisms 106A-H can each include two or more sets of rollers and belts stack on one another, such as shown in FIG. 3. The document feeders can be operated using tracks that are used to bring the document to the respective document feeder.

The feeding mechanisms, as shown in FIG. 1, feed a document towards the drum 102 in a direction generally along a diameter axis of the drum 102 (i.e. a linear axis that goes through the center point of the drum 102. However, the feeding mechanisms need not be oriented in this configuration. The feeding mechanisms can be oriented to guide a diameter in a direction that is off a diameter axis of the drum 102.

The guiding mechanism 108A-D can have limited rotational mobility so as to be allowed to be situated in a limited number of positions. In one or more embodiments, the guiding mechanism can be situated in only three distinct positions: an input position, an output position, and a neutral position. Assuming the motor 118 is configured to rotate the drum in the counter-clockwise direction, the guiding mechanism 108B is in an input position, the guiding mechanisms 108A and 108D are in neutral positions, and the guiding mechanism 108C is in an output position.

In one or more embodiments, the guiding mechanism 108A-D can be situated in only two distinct positions: an input and neutral position (e.g., a passive position), and an output position (e.g., an active position). Such a configuration can reduce the amount of power required to operate the document diverter 100 as compared to an embodiment that includes three positions. This is because the guiding mechanisms 108A-D does not need to be moved between input and neutral positions when the guiding mechanism 108A-D includes only a passive and an active position.

A document can be directed to the document feed including the feeding mechanisms 106C-D. The feeding mechanisms 106C-D can be spun in opposite directions (e.g., clockwise and counter-clockwise, respectively) by the motor 110B so as to cause a document to be fed between the feeding mechanisms 106C-D towards the drum 102. The guiding mechanism 108B can direct the document to the channel 116 between the drum 102 and the drum guides 104A-D. The drum 102, being spun in the counter-clockwise direction, can cause the document to move towards the document feeder including the feeding mechanisms 106A-B. The guiding mechanism 108A, being in a neutral position, can cause the document to remain in the channel 116 and continue towards the document feeder include the feeding mechanisms 106G-H. The guiding mechanism 108D, being in a neutral position, can cause the document to remain in the channel 116 and continue towards the document feeder include the feeding mechanisms 106E-F. The guiding mechanism 108C, being in an output position, will guide the document out of the channel 116 and to the feeding mechanisms 106E-F. The feeding mechanisms 106E-F can be spun in opposite directions (e.g., counter-clockwise and clockwise, respectively) by the motor 110C so as to cause a document to be fed between the feeding mechanisms 106E-F away from the drum 102 and to a corresponding document path.

The document diverter can act as a roundabout for a document. A document can enter the document diverter at any of the document feeders and be fed in the channel 116 until the document reaches a guiding mechanism that guides the document out of the channel 316.

The motors 110A-D and 118 can be brushed or brushless motors, such as stepper motors. The motors 110A-D and 118 can be electrically coupled to the processing circuitry 112, which can control the rotational direction, speed, and distance of the motors 110A-D and 118.

The control logic 112 can include one or more electrical or electronic components (e.g., a transistor, resistor, capacitor, inductor, relay, logic gates, Application Specific Integrated Circuit (ASIC) or other IC, multiplexer, clock, processor, memory, a motor driver circuit, or other electrical or electronic components). The control logic 112 can be electrically coupled to the motors 110A-D, 118, and the sensors 114A-D (couplings between the sensors 114A-D, the motor 118, and the control logic 112 are not shown in FIG. 1 for clarity purposes). The control logic 112 can send signals to the motors 110A-D, and 118, that cause the motors 110A-D, or 118 to rotate the feeding mechanisms 106A-H or the drum 102.

The control logic 112 can receive signals indicative of a user requesting an operation to be performed at an SST, such as depositing or requesting money, or depositing a check. The control logic 112 can receive signals from the sensors 114A-D and perform operations based on the signals received. The signals from the sensors 114A-D can indicate to the control logic that a document has cleared a document feeder and that control logic can move a corresponding guiding mechanism 108A-D, stop a motor 110A-D from operating, or change an operation of the motor 110A-D. For example, consider a document input through the document feeder including the feeding mechanisms 106C-D. The sensor 104B can detect when the document is present in the channel 116 and at least partially blocking the sensor 114B, and the sensor 114B can detect when the document is no longer present in the channel 116 and at least partially blocking the sensor 114B. The sensor 114B can send signals indicating these conditions to the control logic 112. The control logic 112 can, for example, change the position of the guiding mechanism 108B, from input, to either neutral or output, in response to receiving the signal indicating the document is no longer between the sensor 114B and the drum 102 (i.e. the document has cleared the document feeder). In addition, or alternatively, the control logic 112 can cause the motor 110B to stop operating or can cause the motor 110B to reverse direction so as to make the document feeder reverse directions and become an output.

The sensors 114A-D can include a proximity, infrared, or other type sensor capable of detecting an object's presence in the channel 116. The sensors 116 are depicted in FIG. 1 as residing on or at least partially in the drum guides 104A-D, however the sensors 114A-D can be located elsewhere, such as on or at least partially in the drum 102, on a pole (see FIG. 3) holding the feeding mechanisms 106A-H in place (e.g., between, over, or under feeding mechanisms on the pole), or other location on or at least partially in the document diverter so long as they are capable of or indicating a location of a document in the document diverter.

The channel 116 is the gap between the drum 102 and the drum guides 104A-D and document feeders that provide space for a document to be transported therein and therethrough.

Figure 2:
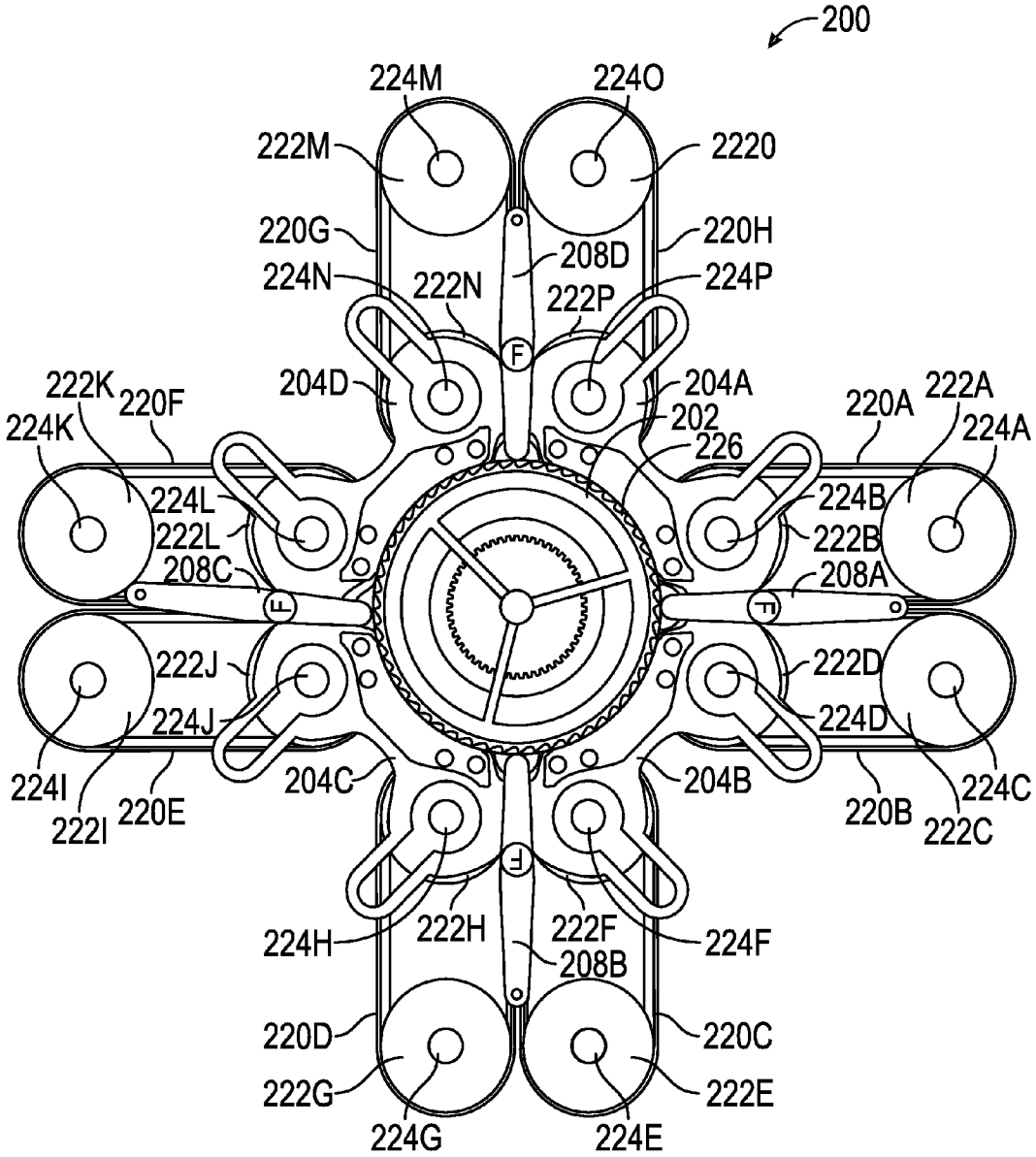
FIG. 2 is a perspective view diagram of a document diverter, according to an example embodiment.

FIG. 2 illustrates, by way of example, a perspective view diagram of an embodiment of a document diverter 200. As illustrated, the document diverter 200 includes a drum 202, drum guides 204A, 204B, 204C, and 204D, guiding mechanisms 208A, 208B, 208C, and 208D, belts 220A, 220B, 220C, 220D, 220E, 220F, 220G, and 220H, rollers, 222A, 222B, 222C, 222D, 222E, 222F, 222G, 222H, 222I, 222J, 222K, 222L, 222M, 222N, 222O, and 222P, posts 224A, 224B, 224C, 224D, 224E, 224F, 224G, 224H, 224I, 224J, 224K, 224L, 224M, 224N, 224O, and 224P, and a cover 226 on the drum 202.

The drum 202 can be substantially the same as the drum 102, with the drum 202 including a cover 226 thereon. The cover 226 can be dentated or jagged so as to provide a space where a document can catch and be pushed along by the cover 226. The cover 226 can be made of a polymer material that is elastic, such as a rubber, so that the cover 226 can deform to a surface. The cover 226 can be made of a high friction material to help push a document in contact therewith. The cover 226 can cover all or just a portion of the drum 202 facing outwards (i.e. the portion of the drum facing the drum guides 204A-D). A drum that includes such a cover is called a rubberized drum.

Each feeding mechanism can include a belt 220A, 220B, 220C, 220D, 220E, 220F, 220G, and 220H, respectively, and two rollers 222A and 222B, 222C and 222D, 222E and 222F, 222G, and 222H, 222I and 222J, 222K and 222L, 222M and 222N, and 222O and 222P, respectively. A document can be guided between adjacent belts 220A and 220B, 220C and 220D, 220E and 220F, or 220G and 220H. The belts 220A-H can be turned by turning one or more of the rollers 222A-P the belt is situated around, such as by operation of a motor (motor not shown in FIGS.). The rollers 222A-p can be mounted on respective posts 224A, 224B, 224C, 224D, 224E, 224F, 224G, 224H, 224I, 224J, 224K, 224L, 224M, 224N, 224O, and 224P. The posts 224A-P can be mechanically connected to the respective roller 222A-P such that when the post 224A-P is rotated, the respective roller 224A-P rotates as well. The posts 224A-P can be threaded on a portion thereof to provide locations for mounting the document diverter 200 to a plate or other structure.

The adjacent belts 220A-H can contact the document and the friction created between the respective belt 220A-H and the document can provide enough force to transport the document towards the drum 202. On input of the document into a feeding mechanism, the position of the guiding mechanism 208A-D around the respective feeding mechanism is at an input position, or will be at an input position by the time the document reaches the drum 202.

FIG. 3 illustrates, by way of example, another perspective view diagram of an embodiment of the document diverter 200 of FIG. 2. The document diverter 200 as illustrated includes feeding mechanisms that include pairs of rollers and belts stacked over one another on respective poles 224A-P. The rollers 222AA, 222BB, 222CC, 222DD, 222EE, 222FF, 222GG, 222HH, 222II, 222JJ, 222KK, 222LL, 222MM, 222NN, 222OO, and 222PP are each respectively stacked over (or under depending on the perspective) the rollers 222A-P, respectively. Note that some rollers are occluded from the view in FIG. 3. While the perspective occludes the view of a few of the rollers and poles, each feeding mechanism includes four rollers and two belts. For example, a feeding mechanism includes rollers 222AA and 222BB stacked over the rollers 222A and 222B, respectively (i.e. mechanically connected to the posts 224A and 224B at different locations along the posts than the rollers 222A and 222B). While FIG. 3 shows two pairs of rollers and two belts for each feeding mechanism, the feeding mechanism can include more or fewer pairs of rollers and corresponding belts. In one or more embodiments, the feeding mechanisms can include three or more pairs of rollers with a respective belt mechanically coupled to each pair of rollers. In one or more embodiments, each of the feeding mechanisms can include a single pair of rollers and a single pair of rollers and a belt. The rollers and the belt in such embodiments can be wider or substantially wide enough (i.e. in a direction perpendicular to a diameter of the roller) to cover all or a substantial majority of a document input or output through the feeding mechanism.

As is the same in the document diverter 200, each pair of rollers can include a belt 220A-H, 220AA, 220BB, 220CC, 220DD, 220EE, 220FF, 220GG, or 220HH situated around the respective pair of rollers. As a respective pole 224A-P rotates each of the attached rollers 222A-P and 222AA-PP rotates, thus rotating the belts 220A-H and 220AA-HH mechanically coupled to the rollers 222A-P and 222AA-PP.

Figure 4:
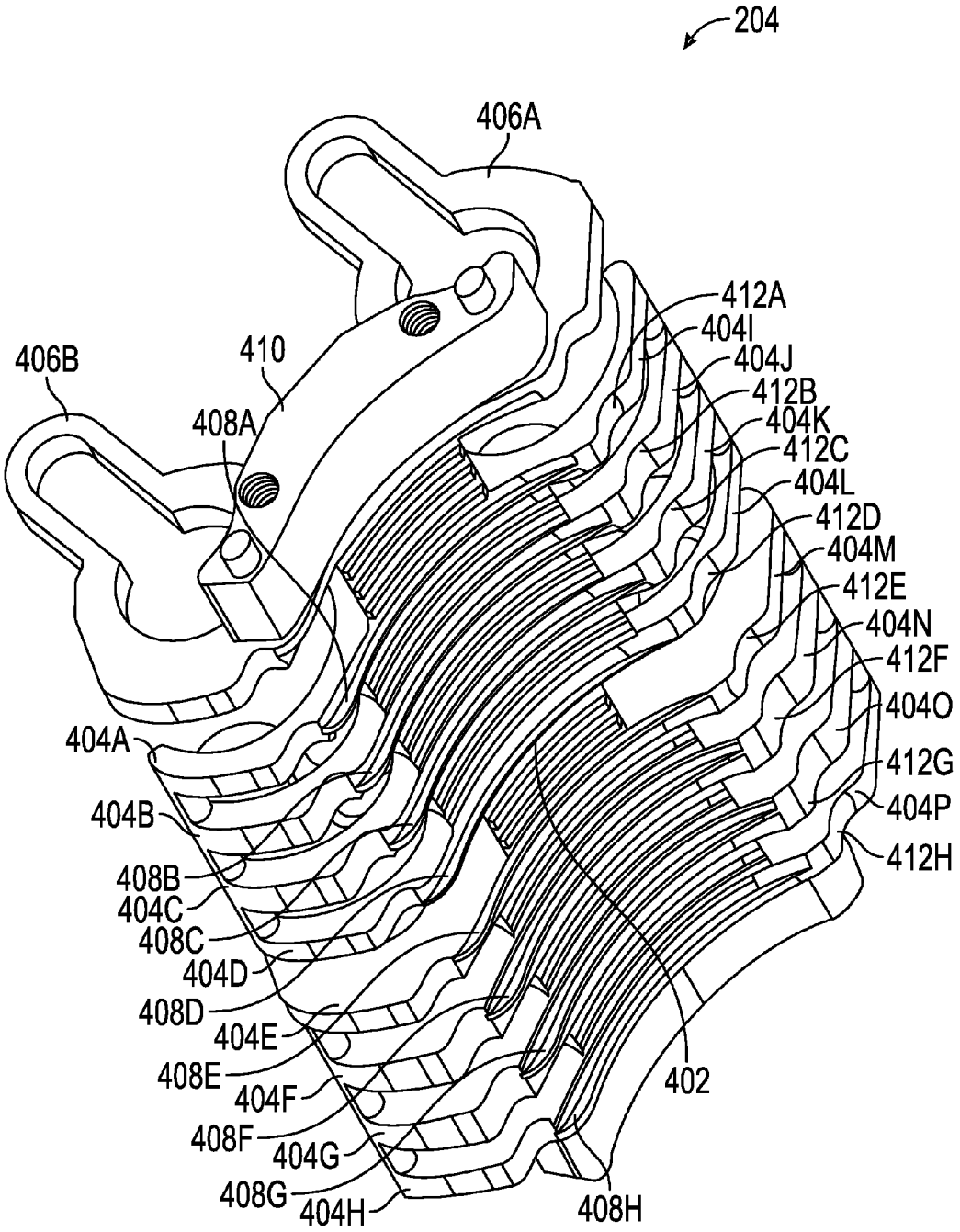
FIG. 4 is a perspective view diagram of a drum guide, according to an example embodiment.

FIG. 4 illustrates, by way of example, a perspective view diagram of an embodiment of a drum guide 204. Any of the drum guides 104A-D or 204A-D can be configured similar to or the same as drum guide 204. The drum guide 204 includes a spine 402, a plurality of ribs 404A, 404B, 404C, 404D, 404E, 404F, 404G, 404H, 404I, 404J, 404K, 404L, 404M, 404N, 404O, and 404P extending from the spine 402, and a plurality of arms 406A and 406B extending from the spine in a direction generally orthogonal to the ribs 404A-P.

The spine 402 is curved so as to generally mirror the shape of the drum 102 or 202. The spine 402 can be corrugated, such as to allow air flow between the document and the drum guide 204 or to allow a document to form to the corrugations. Corrugations can be directional so as to permit a document to travel in only one direction around the drum 102 or 202. For example, the spine 402 of FIG. 4 includes protrusions 408A, 408B, 408C, 408D, 408E, 408F, 408G, and 408H, near the respective ribs 404A-H. The protrusions 408A-H push a document closer to the drum 102 or 202 and can provide space for a guiding mechanism 108A-D or 208A-D to help guide the document in the proper direction.

The ribs 404A-P are separated by a gap configured to permit a portion of the guiding mechanism 108A-D or 208A-D therein or therethrough. The ribs 404A-P can each include an indent 412A, 412B, 412C, 412D, 412E, 412F, 412G, and 412H therein to permit a greater range of motion for the guiding mechanisms 108A-D or 208A-D.

The arms 406A-B can be mechanically coupled to the spine 402 by a shoulder 410. The arms 406A-B can each include a slotted hole therein that can be used to attach and/or align the document diverter 100 or 200 in an SST.

Figure 5:
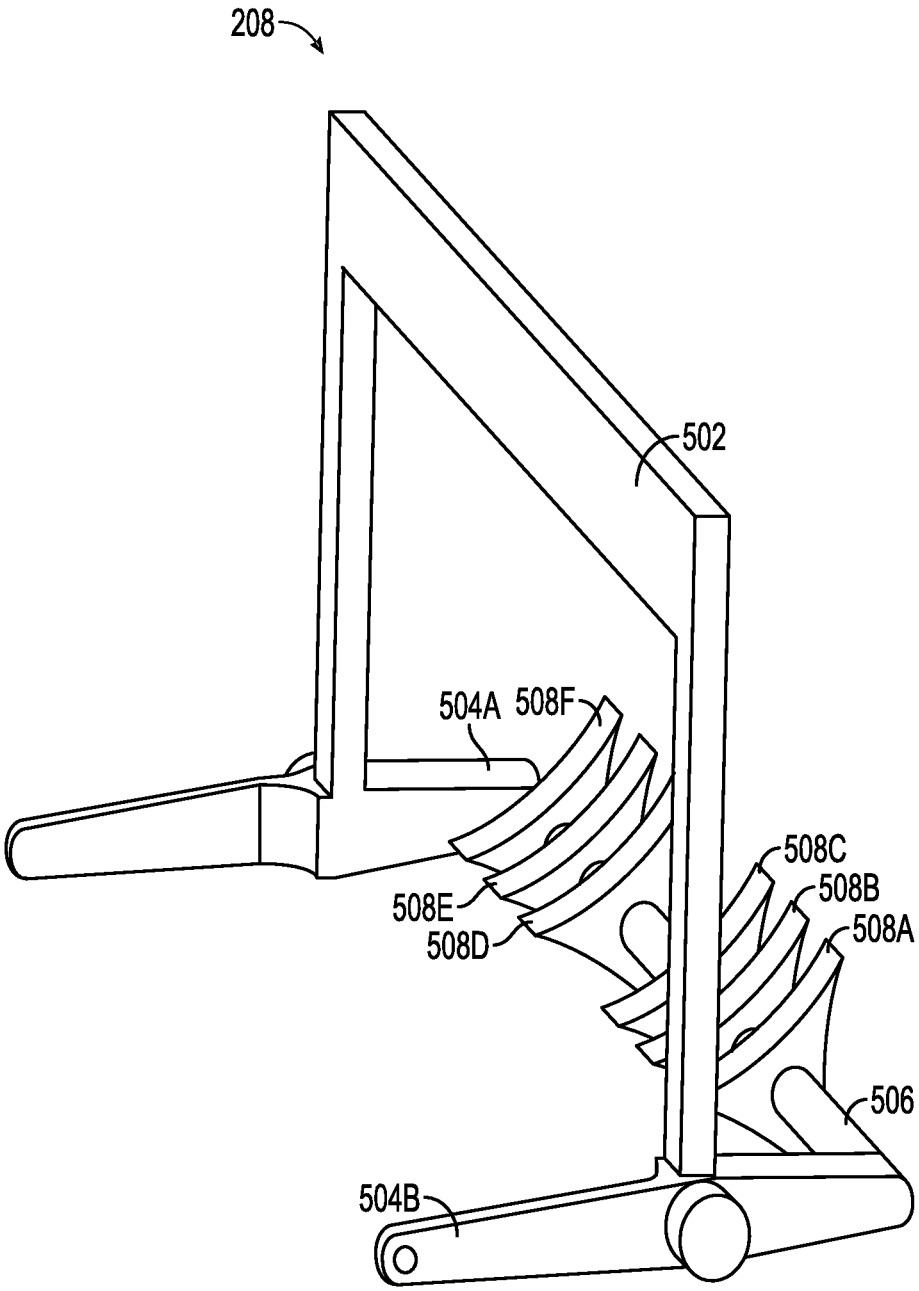
FIG. 5 is a perspective view diagram of a guiding mechanism, according to an example.

FIG. 5 illustrates, by way of example, an embodiment of a guiding mechanism 208. The guiding mechanisms 108A-D and 208A-D can be configured similar to or the same as the guiding mechanism 208 of FIG. 5.

The guiding mechanism 208 includes a U-shaped frame 502, two arms 504A and 504B attached to opposite sides of the U-shaped frame 502, a post 506 connected to each of the arms 504A-B, and a plurality of flaring protrusions 508A, 508B, 508C, 508D, 508E, and 508F on the post 506.

The U-shaped frame 502 can be moved, such as by a motor, to alter the position of the flaring protrusions 508A-F. The position of the flaring protrusions 508A-F determines the position of the guiding mechanism 208 (e.g., input, output, or neutral).

The arms 504A-B can be oriented generally perpendicular to the cross bars and the back bone thereof. The cross bars are attached to the arms 504A-B and the back bone is connected to both of the cross bars. The arms 504A-B can include protrusions, a hole, a post, or other feature configured to keep the guiding mechanism 208 in place relative to the drum guides 108A-D or 208A-D and the corresponding feeding mechanism.

The post 506 can be generally perpendicular to the arms 504A-B and the cross bars of the U-shaped frame 502 and parallel to the back bone of the U-shaped frame 502. The flaring protrusions 508A-F can be shaped on a side facing the drum 102 or 202 that mirrors the shape of the drum 102 or 202 when the guiding mechanism 208 is in the neutral position. The indent 412A-H can be shaped to mirror the shape of the post 206. The flaring protrusions 508A-F can be situated along the post 506 such that when the frame 502 is moved to an input or output position the flaring protrusions 508A-F are positioned partially in a gap between the ribs 404A-P.

Figure 6:
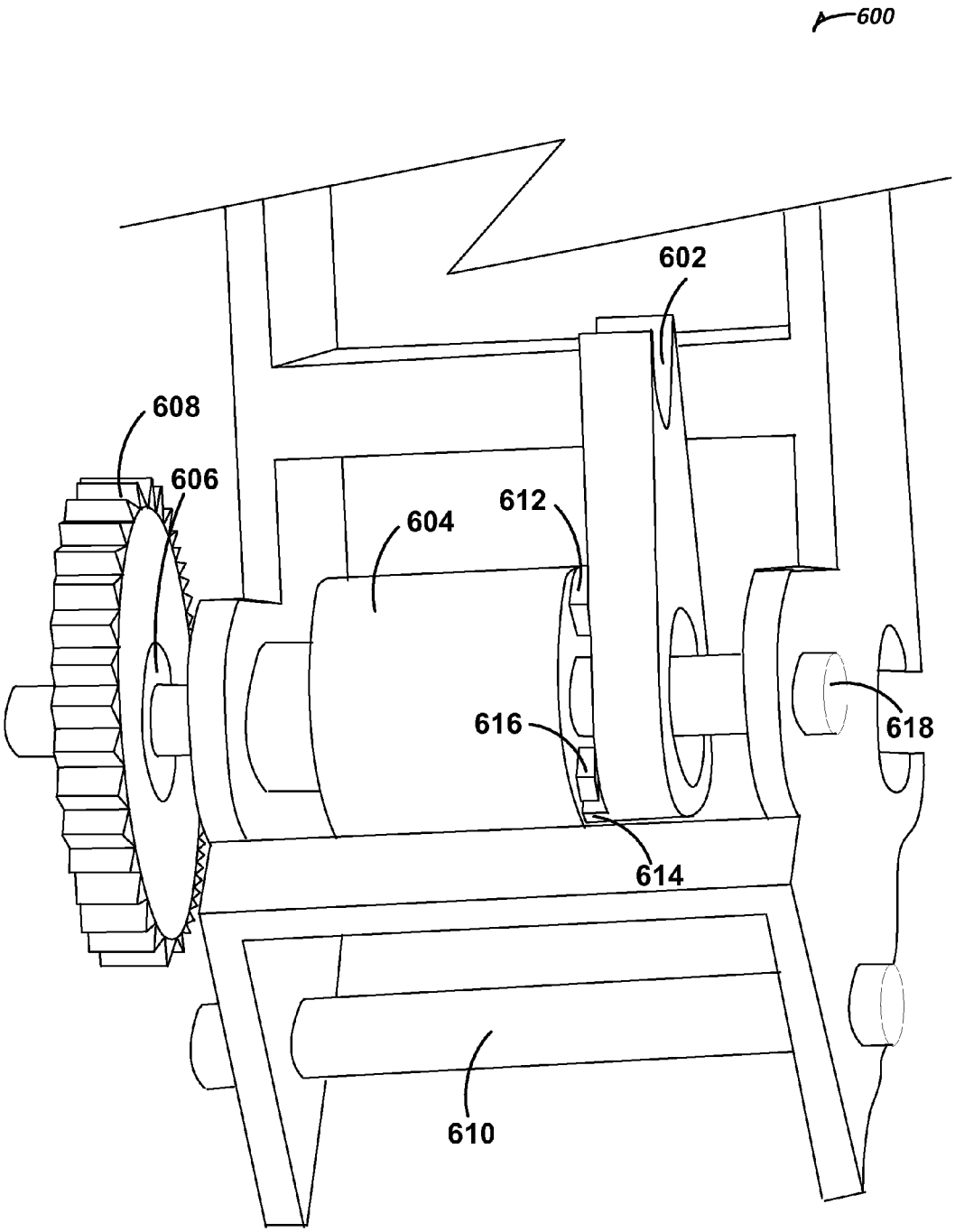
FIG. 6 is a perspective view diagram of a switching mechanism to move a guiding mechanism from a first position to a second position.

FIG. 6 illustrates a perspective view diagram of a switching mechanism 600 to switch a guiding mechanism 108A-D or 208A-D from a first position to a second position. The switching mechanism 600 as illustrated includes an actuator 602, a friction clutch 604, a one-way bearing 606, and a gear 608. A post 610 can be any of the posts 224A-P of FIG. 2. The belt 220A-H or 220AA-HH can be situated around the post 610.

When a set of belts of a document feed is moving such as to direct a document towards the drum 102 or 202 the switching mechanism 600 is at rest and in a neutral position and thus a guiding mechanism 108A-D or 208A-D is likewise in a neutral position. In response to a set of belts of a document feeder activating to take a document away from the drum 102, the one-way bearing 606 locks transferring a torque on the belt shaft 610 to an actuator shaft 618 (e.g., by activation of the gear 608). The actuator shaft 618 includes the friction clutch and the actuator attached thereto. The actuator 602 includes a plurality of stops 612 and 614 attached thereto and the friction clutch includes a stop 616 attached thereto, such that when the shaft 618 rotates, the stop 616 contacts the stop 612 or 614, thus pushing the actuator into an activated (e.g., eject) or inactive (e.g., an input and neutral) position. When the actuator 602 stop 612 or 614 the friction clutch 604 can slip enough to keep the actuator 602 in the active position and not over-rotate the actuator 602. When the actuator shaft 618 is stops rotating a spring (not shown in FIG. 6) can return the actuator 602 back to the inactive position. Using the switching mechanism 600 of FIG. 6 (e.g., one switching mechanism 600 for each document feeder), the motors 110A-D are not needed and the document feeders can operate using the track used to direct the document to the document feeders.

Figure 7:
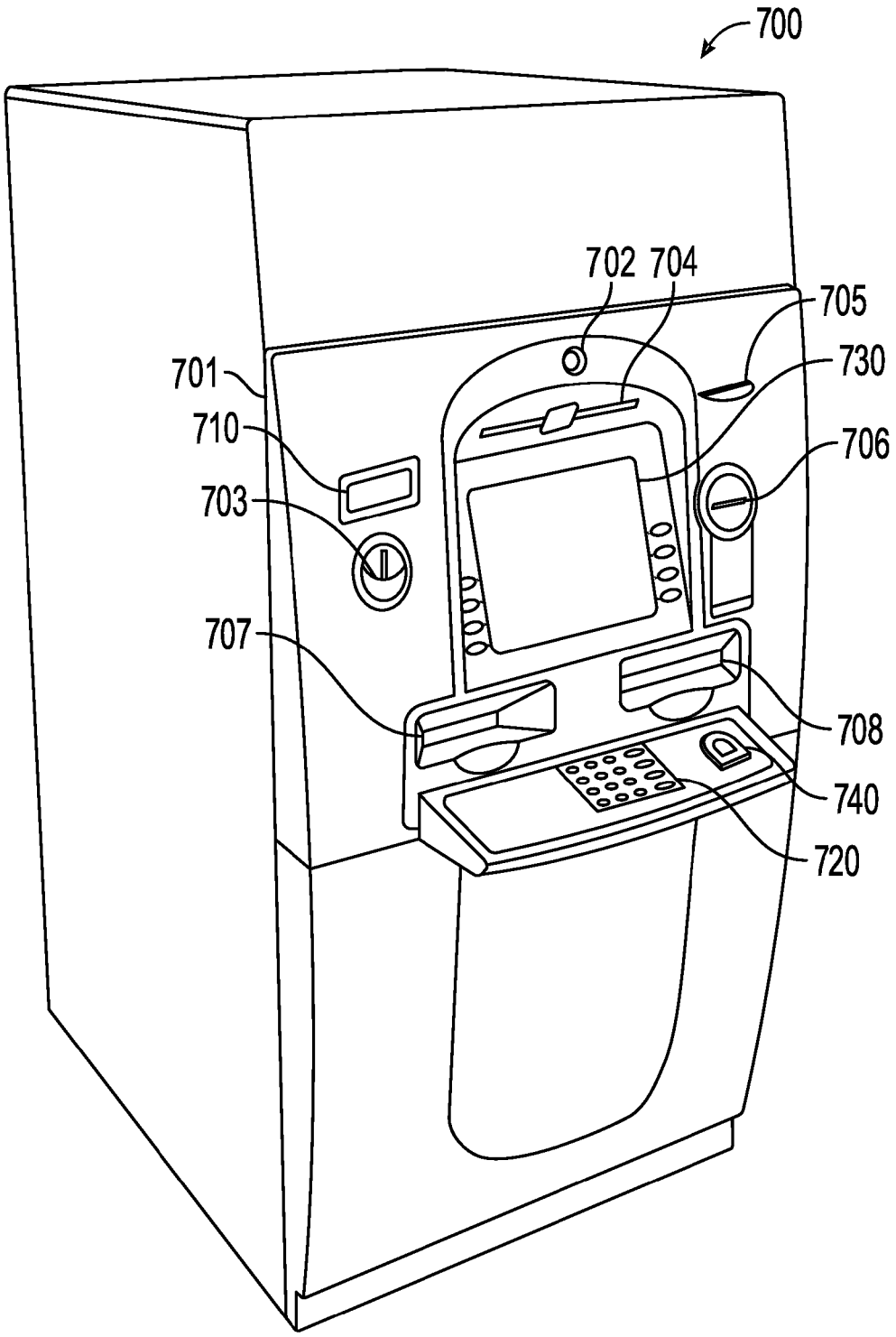
FIG. 7 is a diagram of a Self Service Terminal, according to an example.

FIG. 7 illustrates, by way of example, a perspective view diagram of an embodiment of an SST in the form of an automated teller machine (ATM) 700. The ATM 700 as illustrated includes a fascia 701 coupled to a chassis (not shown). The fascia 701 defines a number of slots for receiving and dispensing media items and a tray 703 into which coins can be dispensed. The slots include a statement output slot 704, a receipt slot 705, a card reader slot 706, a cash slot 707, a further cash slot 708, and a check input/output slot 710. The slots and tray are arranged such that the slots and tray align with corresponding ATM modules mounted within the chassis of the ATM. The fascia 701 provides a user interface for allowing an ATM customer to execute a transaction. The fascia 701 includes an encrypting keyboard 720 for allowing an ATM customer to enter transaction details. A display 730 is provided for presenting screens to an ATM customer. A fingerprint reader 740 is provided for reading a fingerprint of an ATM customer to identify the ATM customer.

Within the chassis of the ATM it will be understood that items of media must be transported from time to time from one location to another. The pathway taken by any particular item of media is dependent upon an operation being carried out at the ATM and may also be dependent upon other factors such as whether a user of the ATM is authorized and/or whether an item of media (e.g., a document) being transported satisfies certain pre-determined criteria. The control logic 112 can receive data indicative of the operation being out at the ATM and/or the other factors, and can control the motors of the document diverter based on the received data. Documents (e.g., checks, money, or other documents) can be routed to a document diverter discussed herein, which can direct the document to the proper destination within the ATM 700 or to an output slot, such as the output slot 710.

In an example, the user touch or user selections described above may include encrypted touch or encrypted user selections. For example, the user selections may bypass certain software running on an SST for added security or run in a secure mode.

In an example, an SST may include a kiosk (e.g., a movie rental machine, a vending machine, etc.). In an example, an SST may include an ATM. In an example, an SST may include a Point of Sale (POS) device. In an example, an SST may include a card authentication system, such as a credit card authorization system. The card authentication system may include a card matching or generation system or a card authenticator of a pre-made card.

Notes & Examples

Each of these non-limiting examples can stand on its own, or can be combined in various permutations or combinations with one or more of the other examples.

Example 1 can include or use the subject matter embodied by a document diverter comprising a drum, a plurality of document feeders situated around the drum with a document channel between the document feeders and the drum; and a plurality of guiding mechanisms, one guiding mechanism for each of the plurality of document feeders, each of the plurality of guiding mechanisms including a plurality of positions including an first position and a second position.

Example 2 can include the subject matter of Example 1, and can further include wherein the document diverter further comprises a plurality of guide motors, one guide motor mechanically coupled to each guiding mechanism to switch the guiding mechanism between the plurality of positions; and control logic electrically coupled to the guide motors to control the operation of the motors.

Example 3 can include or use the subject matter of at least one of Examples 1-2 and can further include a plurality of sensors, each of the plurality sensors situated proximate a respective document feeder, each sensor to produce a signal indicating a document has cleared the respective document feeder, and wherein the control logic is configured to cause a motor of the plurality of motors to switch a guiding mechanism of the plurality of guiding mechanisms from first position of the plurality of positions to a second position of the plurality positions in response to receiving the signal indicating the document has cleared the respective document feeder.

Example 4 can include or use the subject matter of at least one of Examples 1-2 and can further include, wherein the control logic, guide motors, sensors, and guiding mechanisms are configured to allow a document to be input to any one of the plurality of document feeders and allow the document to be output on any one of the other document feeders of the plurality of document feeders to provide a twelve way document diverter.

Example 5 can include or use the subject matter of at least one of Examples 1-2 and can further include, wherein the control logic, guide motors, sensors, and guiding mechanisms are configured to allow a document to be input on any of the plurality of document feeders and allow the document to be output on any of the plurality of document feeders to provide a sixteen way document diverter.

Example 6 can include or use the subject matter of at least one of Examples 1-6 and can further include, wherein the first position is an input position and the second position is an output position.

Example 7 can include or use the subject matter of at least one of Examples 1-6 and can further include, wherein each of the guiding mechanisms includes two elastic members in close proximity, wherein each elastic member of the two elastic members is fixed around two rollers.

Example 8 can include or use the subject matter of at least one of Examples 1-7 and can further include, wherein the drum includes a drum motor situated at least partially in an opening of the drum, mechanically coupled to the drum, and electrically coupled to the control logic, the control logic to control the operation of the drum motor.

Example 9 can include or use the subject matter of at least one of Examples 1-8 and can further include a plurality of drum guides, one drum guide between each pair of adjacent document feeders.

Example 10 can include or use the subject matter of Example 9 and can further include, wherein the guide motors are each situated on a respective drum guide of the plurality of drum guides.

Example 11 can include or use the subject matter embodied by a document diverter comprising a drum, a drum motor situated at least partially within the drum and mechanically coupled to the drum to rotate the drum, four document feeders situated radially about the drum, four guiding mechanisms, one guiding mechanism for each of the plurality of document feeders, each of the four guiding mechanisms including three positions, an input position, an output position, and a neutral position, four guide motors, one guide motor mechanically coupled to each guiding mechanism to switch the guiding mechanism between the three positions, and control logic electrically coupled to the guide motors and the drum motor to control the operation of the motors.

Example 12 can include or use the subject matter of Example 9 and can further include, four sensors electrically coupled to the control logic, each of the four sensors situated proximate a respective document feeder, each sensor to produce a signal indicating a document has cleared the respective document feeder, and wherein the control logic is configured to cause a motor of the plurality of motors to switch a guiding mechanism of the plurality of guiding mechanisms from a first position to a second position in response to receiving the signal indicating the document has cleared the respective document feeder.

Example 13 can include or use the subject matter of at least one of Examples 11-12 and can further include four drum guides, one drum guide between each pair of adjacent document feeders, the drum guides situated in proximity to the drum so as to form a document channel between the drum guides and the drum.

Example 14 can include or use the subject matter of Example 13 and can further include, wherein each drum guide includes a corrugated spine shaped to mirror a curve of the drum, a plurality of ribs extending from each side of the spine, and a gap between adjacent ribs on each side of the spine to accommodate a flaring protrusion of the guiding mechanism.

Example 15 can include or use the subject matter of at least one of Examples 11-14 and can further include, wherein each guiding mechanism includes a backbone mechanically connected to two cross bars to form a U-shaped frame, an arm mechanically connected to each of the two cross bars generally perpendicular to the backbone and the crossbars, a pole connected between the two arms generally parallel to the backbone, and a plurality of flaring protrusions situated along the post.

Example 16 can include or use the subject matter embodied by a Self Service Terminal (SST) comprising a document input and output slot, a document diverter mechanically coupled to the input and output slot, the document diverter comprising: a drum, a plurality of document feeders situated around the drum, a plurality of drum guides, each drum guide situated between a pair of adjacent document feeders so as to form a document channel between the document feeders and the drum, and a plurality of guiding mechanisms, one guiding mechanism for each of the plurality of document feeders, each of the plurality of guiding mechanisms including a plurality of positions including an input position and an output position.

Example 17 can include or use the subject matter of Example 16 and can further include a plurality of guide motors, one guide motor mechanically coupled to each guiding mechanism to switch the guiding mechanism between the plurality of positions, and control logic electrically coupled to the guide motors to control the operation of the motors.

Example 18 can include or use the subject matter of at least one of Examples 16-17 and can further include a plurality of sensors, each of the plurality sensors situated proximate a respective document feeder, each sensor to produce a signal indicating a document has cleared the respective document feeder, and wherein the control logic is configured to cause a motor of the plurality of motors to switch a guiding mechanism of the plurality of guiding mechanisms from an input position to an output position in response to receiving the signal indicating the document has cleared the respective document feeder.

Example 19 can include or use the subject matter of at least one of Examples 17-18 and can further include, wherein the control logic, motors, and guiding mechanisms are configured to allow a document to be input on any of the plurality of document feeders and allow the document to be output on any of the plurality of document feeders to provide a sixteen way document diverter.

Example 20 can include or use the subject matter of at least one of Examples 17-18 and can further include, wherein the control logic, guide motors, and guiding mechanisms are configured to allow a document to be input to any one of the plurality of document feeders and allow the document to be output on any one of the other document feeders of the plurality of document feeders to provide a twelve way document diverter.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls. In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first,"

"second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A document diverter comprising:

a drum;

a plurality of document feeders situated around the drum with a document channel between the document feeders and the drum;

a plurality of guiding mechanisms, one guiding mechanism for each of the plurality of document feeders, each of the plurality of guiding mechanisms including a plurality of positions including a first position and a second position;

a plurality of guide motors, one guide motor mechanically coupled to each guiding mechanism to switch the guiding mechanism between the plurality of positions; and control logic electrically coupled to the guide motors to control the operation of the motors;

a plurality of sensors, each of the plurality sensors situated proximate a respective document feeder, each sensor to produce a signal indicating a document has cleared the respective document feeder; and wherein the control logic is configured to cause a motor of the plurality of motors to switch a guiding mechanism of the plurality of guiding mechanisms from first position of the plurality of positions to a second position of the plurality positions in response to receiving the signal indicating the document has cleared the respective document feeder.

2. The document diverter of claim 1, wherein the control logic, guide motors, sensors, and guiding mechanisms are configured to allow a document to be input to any one of the plurality of document feeders and allow the document to be output on any one of the other document feeders of the plurality of document feeders to provide a twelve way document diverter.

3. The document diverter of claim 1, wherein the control logic, guide motors, sensors, and guiding mechanisms are configured to allow a document to be input on any of the plurality of document feeders and allow the document to be output on any of the plurality of document feeders to provide a sixteen way document diverter.

4. The document diverter of claim 1, wherein the first position is an input position and the second position is an output position.

5. The document diverter of claim 1, wherein each of the guiding mechanisms includes two elastic members in close proximity, wherein each elastic member of the two elastic members is fixed around two rollers.

6. The document diverter of claim 1, wherein the drum includes a drum motor situated at least partially in an opening of the drum, mechanically coupled to the drum, and electrically coupled to the control logic, the control logic to control the operation of the drum motor.

7. The document diverter of claim 1, further comprising a plurality of drum guides, one drum guide between each pair of adjacent document feeders.

8. The document diverter of claim 1, wherein the guide motors are each situated on a respective drum guide of the plurality of drum guides.

9. A document diverter comprising:

a drum;

a drum motor situated at least partially within the drum and mechanically coupled to the drum to rotate the drum;

four document feeders situated radially about the drum;

four guiding mechanisms, one guiding mechanism for each of the plurality of document feeders, each of the four guiding mechanisms including three positions, an input position, an output position, and a neutral position;

four guide motors, one guide motor mechanically coupled to each guiding mechanism to switch the guiding mechanism between the three positions; and control logic electrically coupled to the guide motors and the drum motor to control the operation of the motors.

10. The document diverter of claim 9, further comprising:

four sensors electrically coupled to the control logic, each of the four sensors situated proximate a respective document feeder, each sensor to produce a signal indicating a document has cleared the respective document feeder; and wherein the control logic is configured to cause a motor of the plurality of motors to switch a guiding mechanism of the plurality of guiding mechanisms from a first position to a second position in response to receiving the signal indicating the document has cleared the respective document feeder.

11. The document diverter of claim 10, further comprising four drum guides, one drum guide between each pair of adjacent document feeders, the drum guides situated in proximity to the drum so as to form a document channel between the drum guides and the drum.

12. The document diverter of claim 11, wherein each drum guide includes a corrugated spine shaped to mirror a curve of the drum, a plurality of ribs extending from each side of the spine, and a gap between adjacent ribs on each side of the spine to accommodate a flaring protrusion of the guiding mechanism.

13. The document diverter of claim 12, wherein each guiding mechanism includes a backbone mechanically connected to two cross bars to form a U-shaped frame, an arm mechanically connected to each of the two cross bars generally perpendicular to the backbone and the crossbars, a pole connected between the two arms generally parallel to the backbone, and a plurality of flaring protrusions situated along the post.

14. A Self Service Terminal (SST) comprising:

a document input and output slot;

a document diverter mechanically coupled to the input and output slot, the document diverter comprising:

a drum;

a plurality of document feeders situated around the drum;

a plurality of drum guides, each drum guide situated between a pair of adjacent document feeders so as to form a document channel between the document feeders and the drum;

a plurality of guiding mechanisms, one guiding mechanism for each of the plurality of document feeders, each of the plurality of guiding mechanisms including a plurality of positions, an input position and an output position;

a plurality of guide motors, one guide motor mechanically coupled to each guiding mechanism to switch the guiding mechanism between the plurality of positions;

control logic electrically coupled to the guide motors to control the operation of the guide motors; and a plurality of sensors, each of the plurality sensors situated proximate a respective document feeder, each sensor to produce a signal indicating a document has cleared the respective document feeder;

wherein the control logic is configured to cause a guide motor of the plurality of guide motors to switch a guiding mechanism of the plurality of guiding mechanisms from an input position to an output position in response to receiving the signal indicating the document has cleared the respective document feeder.

15. The document diverter of claim 14, wherein the control logic, guide motors, and guiding mechanisms are configured to allow the document to be input on any of the plurality of document feeders and allow the document to be output on any of the plurality of document feeders to provide a sixteen way document diverter.

16. The SST of claim 14, wherein the control logic, guide motors, and guiding mechanisms are configured to allow the document to be input to any one of the plurality of document feeders and allow the document to be output on any one of the other document feeders of the plurality of document feeders to provide a twelve way document diverter.

17. A document diverter comprising:

a drum, including a drum motor situated at least partially in an opening of the drum and mechanically coupled to the drum;

a plurality of document feeders situated around the drum with a document channel between the document feeders and the drum;

a plurality of guiding mechanisms, one guiding mechanism for each of the plurality of document feeders, each of the plurality of guiding mechanisms including a plurality of positions including a first position and a second position; and control logic electrically coupled to the drum motor and configured to control the operation of the drum motor.

18. A document diverter comprising:

a drum;

a plurality of document feeders situated around the drum with a document channel between the document feeders and the drum;

a plurality of drum guides, one drum guide between each pair of adjacent document feeders;

a plurality of guiding mechanisms, one guiding mechanism for each of the plurality of document feeders, each of the plurality of guiding mechanisms including a plurality of positions including a first position and a second position; and a plurality of guide motors, one guide motor mechanically coupled to each guiding mechanism to switch the guiding mechanism between the plurality of positions;

wherein the guide motors are each situated on a respective drum guide of the plurality of drum guides.

* * * * *